US006071348A

United States Patent [19]

Seitz et al.

[11] Patent Number: 6,071,348

[45] Date of Patent: Jun. 6, 2000

[54] ELECTROSTATIC POWDER COATING SYSTEM

[75] Inventors: Kurt Seitz, Widnau; Markus Hasler, Montlingen; Horst Adams, Gallen, all of Switzerland

[73] Assignee: Wagner Inaternational AG, Alstatten, Switzerland

[21] Appl. No.: 09/144,858

[22] Filed: Sep. 1, 1998

[30] Foreign Application Priority Data

Sep. 1, 1997 [DE] Germany ..... 197 38 097

[51] Int. Cl.[7] ..... B05C 11/10

[52] U.S. Cl. ..... 118/712; 118/629; 118/628; 118/309

[58] Field of Search ..... 118/629, 712, 118/621, 627, 677, 688, 308, 309, 695, 696; 427/458, 478, 469

[56] References Cited

U.S. PATENT DOCUMENTS

| | | | |
|---|---|---|---|
| 4,324,812 | 4/1982 | Bentley | 427/8 |
| 4,357,900 | 11/1982 | Buschor | 118/681 |
| 5,244,499 | 9/1993 | Mazakas | 118/309 |
| 5,506,746 | 4/1996 | Seitz | 361/228 |
| 5,864,239 | 1/1999 | Adams et al. | 324/636 |

FOREIGN PATENT DOCUMENTS

| | | |
|---|---|---|
| 38 22 835 A1 | 3/1990 | Germany . |
| 195 02 390 A1 | 1/1996 | Germany . |
| 44 06 046 C2 | 11/1997 | Germany . |
| 59-109268 | 5/1984 | Japan . |

OTHER PUBLICATIONS

JOT, No. 8, 37 Jahrgang–D13194, Aug. 1997.

"Tschenbuch für Lackierbetriebe 1997", Curt R. Vincentz Verlag, Hannover 1996.

"Neue Steuerungssystee für flexible Lackiertechnik", Von Werner Heine, Kopperschmidt–Mueller GmbH & Co. KG, Winnenden, I–Lack, 53 Jahrgang Jan. 1985, pp. 13–17.

*Primary Examiner*—Richard Crispino
*Assistant Examiner*—George R Koch, III
*Attorney, Agent, or Firm*—Faegre & Benson LLP

[57] ABSTRACT

The present invention provides a method of operating a powder coating system, comprising at least one coating device, a coating compartment and a suction system in the coating compartment. In the method, a workpiece is passed through a coating compartment. The coating powder is discharged by the coating device to the workpiece and excess coating powder is sucked off from the coating compartment, wherein the powder mass flow of the coating powder discharged by the or each coating device is detected and the suction system is controlled in accordance with the powder mass flow. For this purpose the invention provides a powder coating system comprising a measuring means for detecting the powder mass flow of the coating powder discharged by the or any coating device, and an actuator means for setting the suction system in accordance with the powder mass flow.

11 Claims, 3 Drawing Sheets

ELECTROSTATIC POWDER COATING SYSTEM

The present invention refers to a method of operating an electrostatic powder coating system comprising at least one coating device, a coating compartment and one suction system in the coating compartment, in which a workpiece is passed through the coating compartment, coating powder is delivered by the coating device to the workpiece and excess coating powder is sucked off from the coating compartment, and to an electrostatic powder coating system adapted to operate according to this method.

In conventional electrostatic powder coating systems, a workpiece passes through a coating compartment in the horizontal direction, with vertical slots being provided in the side walls of the coating compartment. Coating guns spray the coating medium onto the workpiece through these slots.

The workpieces to be coated may have different shapes and dimensions. They may have for instance small webs, large closed surfaces, cavities, recesses etc. In order to optimize the efficiency when applying the coating medium, i.e. in order to spray as little coating powder as possible past the workpiece, the shape of the cloud of the coating powder discharged by a spray gun may be varied. Nevertheless, some of the coating powder will not impinge on the workpiece surface or will not adhere to the surface depending on the shape of the workpiece. The excess coating powder stays as a powder cloud in the coating compartment, and part of it accumulates on the bottom and the walls of the compartment.

In order to remove the excess coating powder and to largely avoid the powder accumulation, the coating compartments usually comprise a suction system.

The object of the invention is to provide a method of operating a powder coating system, and a powder coating system in which the suction system operates at an optimum efficiency.

This object is achieved by a powder coating system comprising the features of the claims.

According to the present invention a method of operating an electrostatic powder coating system is provided, the powder coating system comprising at least one coating device, and a coating compartment, in which a workpiece is passed through the coating compartment, coating powder is delivered by the coating device to the workpiece and excess coating powder is sucked off from the coating compartment, characterized in that the powder mass flow of the coating powder delivered by each of the at least one coating device is detected and the suction system is controlled in response to the powder mass flow.

According to a further aspect of the invention, an electrostatic coating system is provided, including at least one coating device for delivering electrostatically charged coating powder to a workpiece, a coating department through which the workpiece is fed, and a suction system for sucking off excess coating powder from the coating compartment, characterized by a measuring means for determining the powder mass flow of the coating powder delivered by each of the at least one coating device, and an actuator means for setting the suction system in response to the powder mass flow.

The invention is based on the knowledge that, although in modern powder coating systems, the powder cloud may be adapted to the shape and dimensions of the workpiece, a certain percentage of the coating powder will not reach the workpiece surface or will not adhere thereto. Starting out from the entire powder quantity discharged by all coating devices, the proportion of the excess powder can be estimated on the basis of experimental values, and the efficiency of the suction system is adapted to the powder quantity expected to be sucked off. When detecting that the powder discharge is terminated or interrupted, the suction system may keep on operating during a predetermined delay time and it then switches off automatically.

The method according to the invention on one hand ensures that the suction system constantly operates at the required suction power to prevent an accumulation of excess coating powder in the coating compartment; on the other hand the energy consumption of the suction system, which can be quite high in large coating compartments, is reduced to a necessary minimum, since the suction system is automatically switched off during the spray breaks, and since it constantly operates at the minimum required power.

The powder coating system according to the invention preferably comprises a measuring means for the powder mass flow in the coating device or in each coating device, and an actuator means for the suction system.

The measuring means is preferably integrated into the coating device or arranged in close proximity thereto. Means for measuring a powder mass flow, which are suitable for the purposes of the present invention, are described in German patent applications DE-A-4 406 046 and in DE-A-196 50 112, which are incorporated herein by reference.

The invention will now be described by the aid of a preferred embodiment with reference to the drawings.

Figure 2:
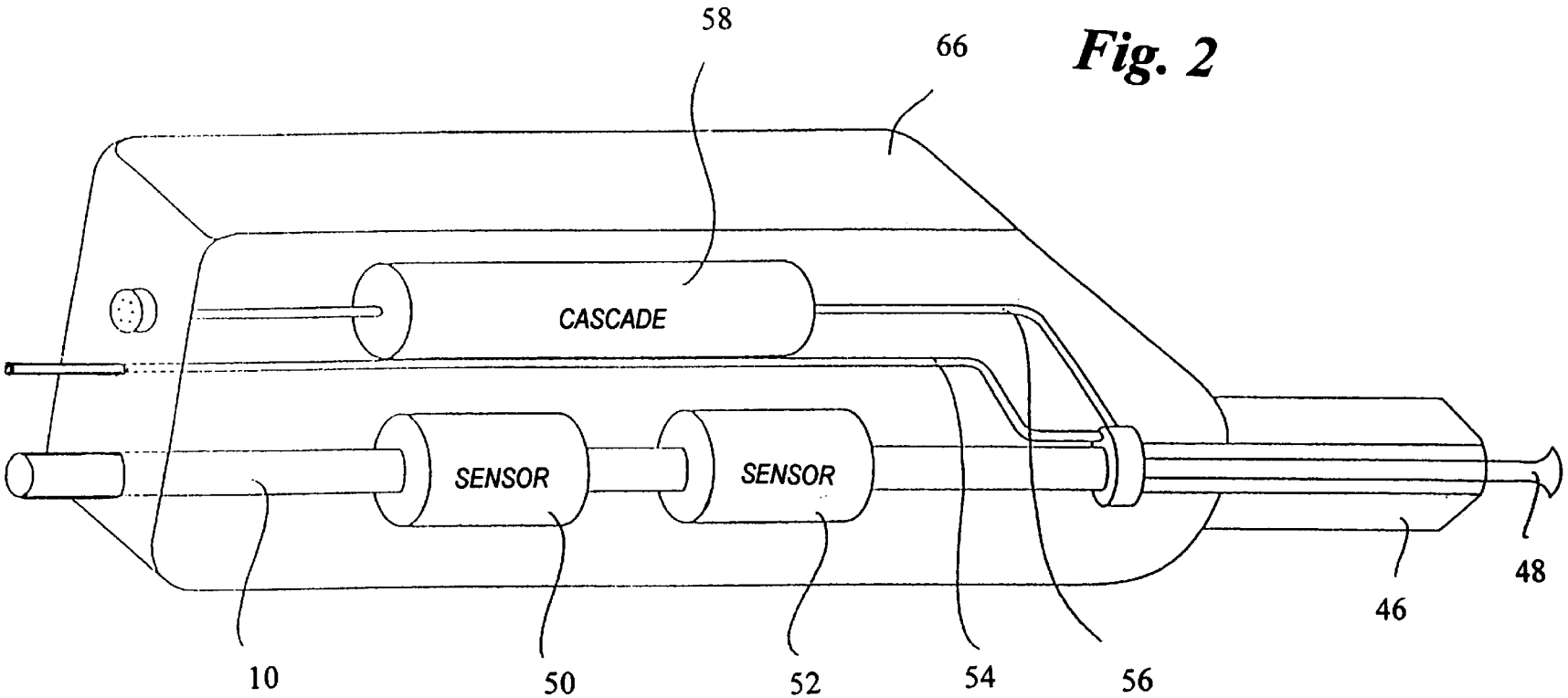
FIG. 2 shows a coating device having an integrated quantity sensor and velocity sensor for the powder coating system of FIG. 1.
Figure 3A:
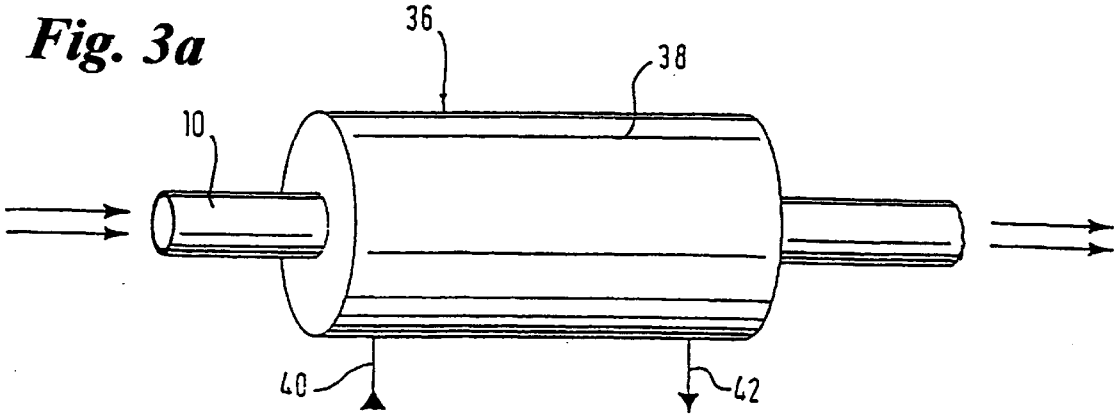
Figure 3B:
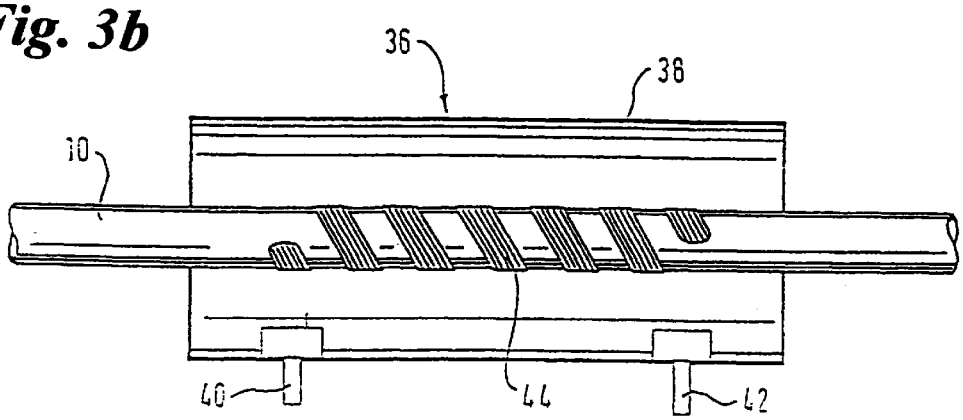
Figure 4:
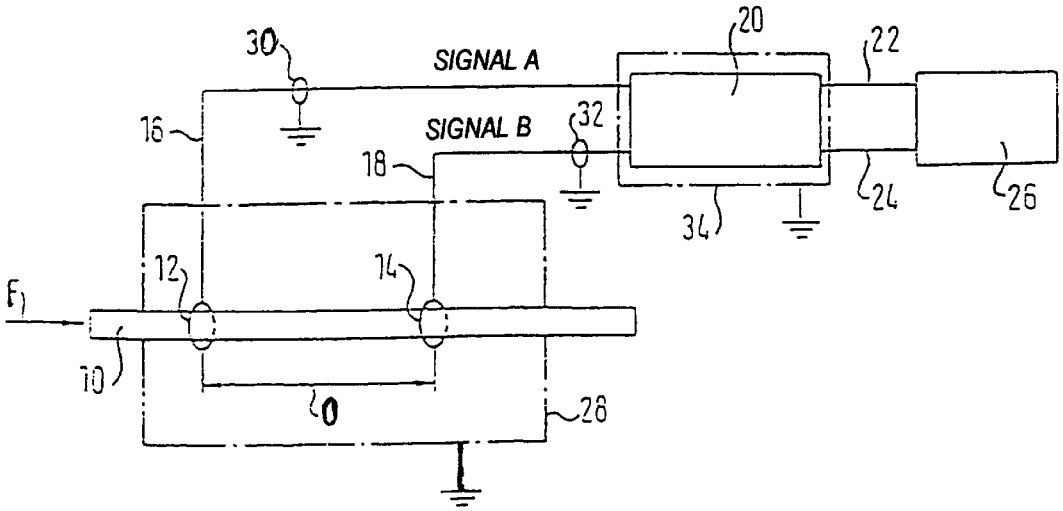

FIGS. 3*a* and 3*b* are an external view and a schematic sectional view of a microwave resonator of the quantity sensor of FIG. 2, respectively; and FIG. 4 is a detailed view of the velocity sensor of FIG. 2.

Figure 1:
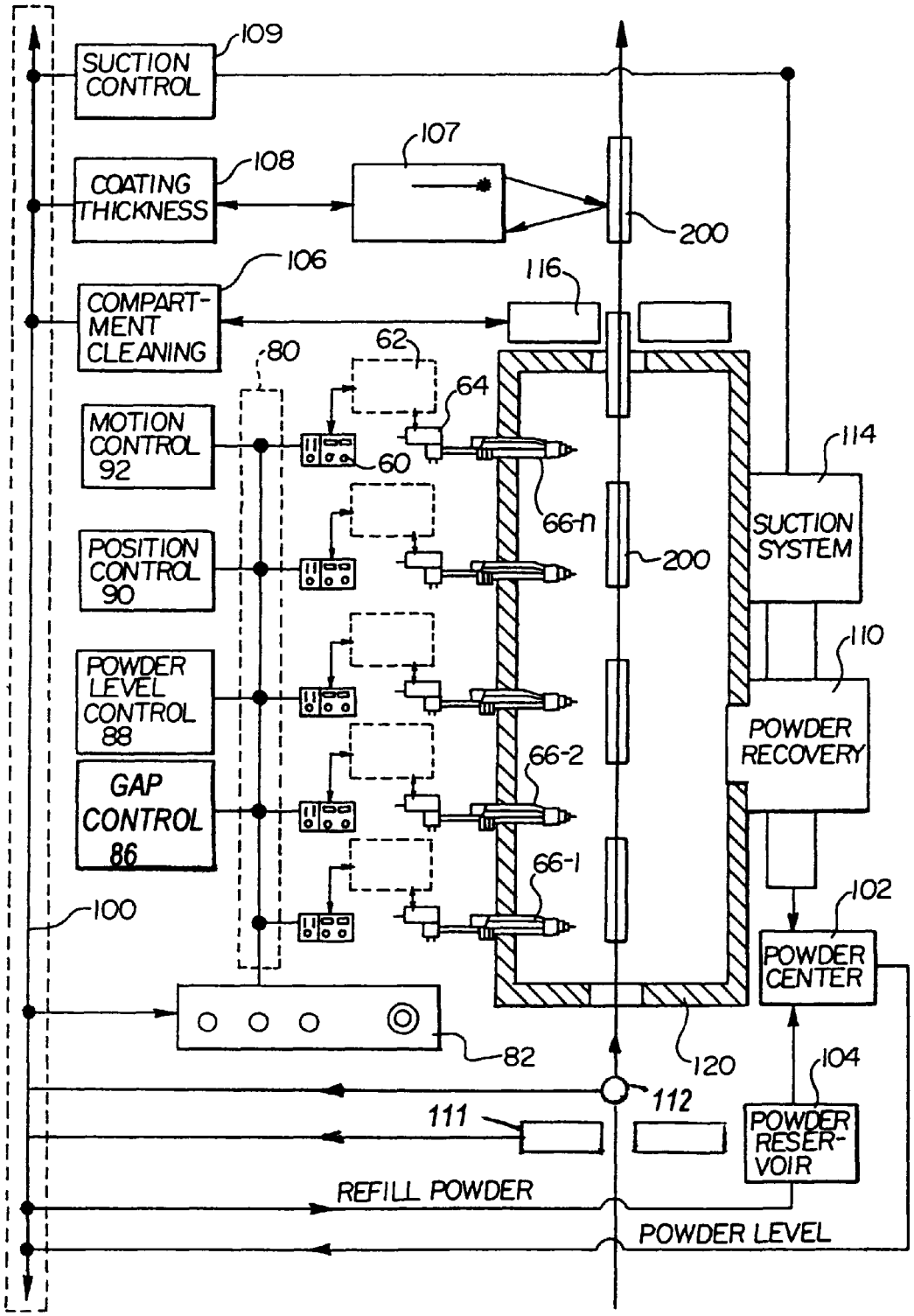
FIG. 1 shows an electrostatic powder coating system according to the invention.

FIG. 1 shows an electrostatic powder coating system in which the method according to the invention can be used. This powder coating system is described in more detail in the German patent application DE-A 19738 141.3 "control system of a coating system" belonging to the same applicant and having the same filing day. The disclosure of this patent application and in particular the explanation of the network structure is incorporated herein by reference.

FIG. 1 shows a plurality (five) of coating modules each consisting of a digital control device 60, an injector actuator means 64 and a spray gun 66, which are connected to one another by a gun bus 62. These coating modules form self-controlling functional units, which receive their control signals from the digital control device 60. Information about the operating condition of the coating system, required for the control, is received by the control device 60 via an internal bus 80.

The internal bus 80 connects the plurality of coating modules to one another and to a central unit 82 and to further components of the system. Additional modules that can be connected to the internal bus are for instance a gap control module 86, a powder level control module 88, a position control module 90 and a motion control module 92.

The internal bus 80 is, as well as the gun bus 62, preferably a LON bus, the digital control unit 62 and the modules are configured as LON network nodes and have a LON interface for connection with the LON bus (LON= local area network).

The central control unit 82 supplies the powder coating system with electric power and pressurized air. Furthermore, the entire system can be switched off by means of this control unit in case of a malfunction.

The gap control module 86 serves for turning off the spray gun in the gaps between the workpieces 200 or workpiece portions. The powder level control module 88 monitors the level in a powder reservoir. The position control module 90 controls the position of the spray guns in the z-direction, i.e. the distance of the spray gun 66 to the workpiece 200. The motion control module 92 controls the vertical stroke and velocity of the up and down movement of the spray gun in response to the height and velocity of the workpiece 200 to be coated.

Furthermore, a powder center 102 having a powder reservoir 104, a layer thickness measuring and control means 107, 108 and a suction control 109 for a suction system 114 of a powder recovery system 110, a workpiece detection and identification means 111, a feed clock generator 112, a control means 106 for compartment cleaning and an associated cleaning means 116 are connected via the external bus 100.

The suction control 109 contains a fan control by means of which the velocity of a suction fan in the suction system 114 and thus the power of the suction system can be adjusted. The suction control 109 receives the necessary information about the powder mass flows delivered by the coating devices from the digital control devices 60 via the buses 100, 80, in order to appropriately adjust the suction power and to activate and deactivate the suction system.

The individual components configured as LON nodes, are capable of registering into the system themselves, they may detect other system components, adapt thereto and communicate therewith. They are able to automatically evaluate and use the information about the respective operating conditions of the coating system received via the bus 80 or 100.

FIG. 2 schematically shows an embodiment of a coating device 66 having an integrated quantity sensor 50, an integrated velocity sensor 52 and an integrated high voltage cascade 58. An adjusted, dosed powder-air-flow is supplied to the coating device 66 via a supply line 10, said flow being discharged by a nozzle 46 having a deflector body 48. A high voltage is generated in a high voltage generator, which is chematically shown as a high voltage cascade 58, and this high voltage is introduced into the powder-air flow via a line 56 and an electrode (not shown) in order to electrically charge the powder particles. FIG. 2 also shows a ground line 54 for connecting the coating device 66 to ground.

The quantity sensor 50 and the velocity sensor 52 serve for determining the powder density and the powder velocity in the supply line. They are described in more detail below with reference to FIGS. 3 and 4.

FIGS. 3*a* and 3*b* show the embodiment of a R.F. resonator 36 of the powder quantity sensor for determining the powder quantity per volume unit in the supply line 10. The supply line is electrically non-conductive, it is passed by the powder-air flow in the direction of the arrow in FIG. 3*a*.

The resonator 36 has a metal cylinder 38 for shielding stray fields, with an RF input 40 and a RF output 42 for coupling R.F. or for tapping the resonator voltage being provided at the metal cylinder. The resonator 44 is provided in the interior of the shielding cylinder 38 in the form of a helix or coil which is wound around the supply line 10. This resonator requires very few space so that it can be directly integrated into the spray gun 66. A precisely limited resonance and therefore a high quality can be achieved by the helical resonator. The helical resonator can e.g. be vacuum-evaporated onto the supply line 10 as a thin film metal layer 44 or a wire helix can be used.

A part of the R.F. field generated by the resonator penetrates through the wall of the supply line 10 into the powder-air mixture. The resonance frequency of the resonator and its quality are measured. These magnitudes depend on the dielectric constant and on the absorption (the dielectric loss factor) in the resonance area. The changes of the dielectric constant and the absorption are proportional to the change of the powder quantity in the resonance volume. It results therefrom that a change of the powder quantity in the resonance volume leads to a shift of the resonance frequency and to a change in quality. By measuring the resonance frequency or the quality, a direct conclusion can be made on the powder quantity in the resonance volume. The method for determining the powder mass in the resonance volume is described in more detail in German patent applications DE-A-44 06 046 and DE-A-196 50 112.

FIG. 4 schematically shows the structure of the velocity measuring device. Two measuring electrodes 12, 14 are attached at a distance D to the supply line 10, said measuring electrodes being connected via signal lines 16, 18 and an amplifier 20. The outputs 22, 24 of the amplifier 20 are connected to a measuring value evaluation device 26. The measuring electrodes 12, 14 consist of copper rings, placed around the supply line 10. Furthermore, a grounded shield 48 is placed around the supply line 10 in the measuring area. The signal line 16, 18 and the amplifier 20 also comprises grounded shields 30, 32 and 34, respectively.

The powder particles of the powder-air flow transported through the plastic line 10 are electrostatically charged by friction with the plastic hose material. These charges influence or induce voltages in the measuring electrodes 12, 14 which are supplied to the measuring amplifier 20. The amplifier measures and amplifies the influence voltages generated by the two electrodes 12, 14. The wave forms of these two signals substantially correspond (correlation).

Since the signal wave forms substantially correspond, a clear definition of the time span between two respective signal peaks is possible so that the velocity v of the powder particles in the supply line 10 can be calculated from the delay $\Delta t$ between the two signal peaks and the distance D between the measuring electrodes: $v=D/\Delta t$.

The velocity measuring method is described in further detail in German patent application DE-A-44 06 046.

Thus, the powder quantity and the powder velocity can be determined by means of the above described quantity sensor 50 and the velocity sensor 52 in order to determine the total powder mass flow which is delivered at any time by all coating devices.

The method according to the invention operates as follows. If a workpiece 200 passes through the coating compartment 120, and the coating guns 66 deliver the coating powder to the workpiece, the powder mass flow of each coating device is detected continually and this information is supplied to the remaining modules of the system via the respective control devices 60 and the bus 80. The information about the total powder mass flow delivered by all coating devices is therefore permanently available at the input of the suction control 109 so that this suction control may adjust the suction power of the suction system 114 appropriately. Since in a fully automated system, in which the present invention is preferably used, the shape and dimensions of the workpiece 200 to be coated as well as the feed velocity are known at any time, the suction control may also use this information to adjust the suction system to the expected quantity of excess powder. If a powder mass flow is no longer detected in workpiece gaps or at the end of a coating process, the suction control 109 does not immediately turn off the suction system 114, but lets it operate for a predeterminable delay time in order to completely suck off the powder cloud which formed in the coating compartment 120.

The features disclosed in the description, the claims and the drawing can be meaningful individually or in any combination for realizing the invention in their different embodiments.

What is claimed is:

1. An electrostatic powder coating system comprising at least one coating device (66) for delivering an electrostatically charged coating powder to a workpiece (200), a coating compartment (120) through which the workpiece is fed, and a suction system (109, 114) for sucking off excess coating powder from the coating compartment, characterized by a measuring means (50, 52) for determining the powder mass flow of the coating powder delivered by each of the at least one coating device, and an actuator means (109) for setting the suction system in response to the powder mass flow.

2. A powder coating system according to claim 1, characterized in that the suction system includes suction control means for i) activating the suction system (109, 114) when it is detected that the coating device(s) (66) deliver(s) coating powder, and ii) deactivating the suction system when no coating powder is delivered.

3. A powder coating system according to claim 2, characterized in that the suction control means includes means for delaying deactivation of the suction system (109, 114) until after a delay time has occurred.

4. A powder coating system according to claim 1, characterized in that the measuring means comprises a velocity measuring device (52) and a mass measuring device (50) in the coating device or each of the at least one coating device.

5. A coating system according to claim 4, characterized in that the measuring means comprises a velocity measuring device (12–26), having two measuring electrodes (12, 14) attached at a powder supply line at a spacing to one another, said measuring electrodes detecting charge fluctuations at the powder supply line (10) generated by the supplied powderair mixture and said measuring electrodes generating appropriate voltage signals (A, B) and supplying them to a measuring value processing device (26), which detects the velocity of the powder-air mixture from the interval ($\Delta t$) of the voltage signals and the predetermined distance (D) between the measuring electrodes (12, 14).

6. A coating system according to claim 4, characterized in that the measuring means comprises a mass measuring device (12–26), comprising a microwave resonator (36; 38) in or at the powder supply line (10), which detects fluctuations of the dielectric constant depending on the powder quantity existing in a resonance volume and/or which detects the microwave absorption in the supply line as a shift of the resonance frequency or a change of the microwave amplitude in the microwave resonator (36; 38) and which derives the powder density in the resonance volume from the change of the dielectricity constant and/or the microwave absorption.

7. A powder coating system according to claim 1, characterized in that the actuator means sets the power of the suction system (109, 114) as a function of the total powder mass flow of the coating device(s) (66).

8. A powder coating system according to claim 1, characterized in that each of the at least one coating device has a digital control device (60) associated thereto, said control device comprising calculating means for calculating the powder mass flow.

9. A powder coating system according to claim 8, characterized in that a plurality of coating devices (66) are provided which are connected to their associated digital control device (60) via a gun bus (62) and form a network node, and that the digital control devices (60) are connected to further components of the coating system via a coating bus (80).

10. A powder coating system according to claim 9, characterized in that the actuator means is provided as a network node.

11. A powder coating system according to claim 10, characterized in that the network nodes are local area network nodes.

* * * * *